United States Patent [19]

Foults

[11] 3,987,876

[45] Oct. 26, 1976

[54] LUGGAGE CLOSURE

[75] Inventor: Jonathan Asa Foults, Wolcott, Conn.

[73] Assignee: Scovill Manufacturing Company, Waterbury, Conn.

[22] Filed: Dec. 17, 1975

[21] Appl. No.: 641,541

[52] U.S. Cl. ..... 190/49

[51] Int. Cl.[2] ..... A45C 13/10

[58] Field of Search ..... 190/19, 28, 41 R, 49; 220/321; 292/256, 256.65, 256.67, 256.69

[56] References Cited

UNITED STATES PATENTS 2,721,094 10/1955 Webster ..... 220/321 X 3,468,274 9/1969 Koffler ..... 190/49 X

*Primary Examiner*—Donald F. Norton

*Attorney, Agent, or Firm*—Dallett Hoopes

[57] ABSTRACT

A belt-like element is disposed in aligned channel-like recesses formed respectively along the margins of the luggage closure. Element-tightening means are provided. When the element is tightened, it moves exclusively into one of the recesses permitting the closure to be opened. When the element is relaxed, it is disposed in both recesses, preventing the opening.

9 Claims, 8 Drawing Figures

LUGGAGE CLOSURE

BACKGROUND OF THE INVENTION

1. Field of the Invention

This invention relates to a luggage closure. More specifically, this invention relates to a closure in which the holding means extends for a considerable extent about the closure of the luggage so that the luggage is able to withstand considerable pressure without bursting open, and is highly resistant to unauthorized opening.

2. Description of the Prior Art

In the prior art, it has been customary for luggage such as suitcases to be hinged at one side, and for the opposite side to be fitted with a pair of latches. These latches have often been of the loop-and-hook-type with toggle tightening means so that the suitcase may be packed, closed loosely and hooked, and then have its two halves drawn together by the latches as the toggle is manipulated.

Such closures of the prior art have focused the force holding the closure closed on the latches. A fully packed suitcase has, as a consequence in rough handling, burst its latches, spilling its contents. Additionally, from a security standpoint, it has been found relatively easy to break into a suitcase of the latch-type by placing a tool under the latch and prying it off.

SUMMARY OF THE INVENTION

Under the present invention, the means holding the closure closed extends continuously for a substantial distance along the luggage closure and the result is great strength against accidental or unauthorized opening. Further, if the present closure breaks, it results in a condition in which the luggage is held closed rather than bursting open.

Under the present invention, the two opposite margins of the closure are provided with opposed recesses or channels. Disposed in one of the recesses is a belt-like element attached to the luggage at a first point in the recess, and tightenable by an actuating lever at a point spaced from the first point so that the belt-like element can be disposed either entirely in said recess, or partially in both of the recesses, resulting selectively in an unlocked or locked disposition.

BRIEF DESCRIPTION OF THE DRAWINGS

Other objects of the invention will be apparent from the following specification including the drawings, all of which disclose a non-limiting embodiment of the invention.

DESCRIPTION OF THE PREFERRED EMBODIMENT

Figure 1:
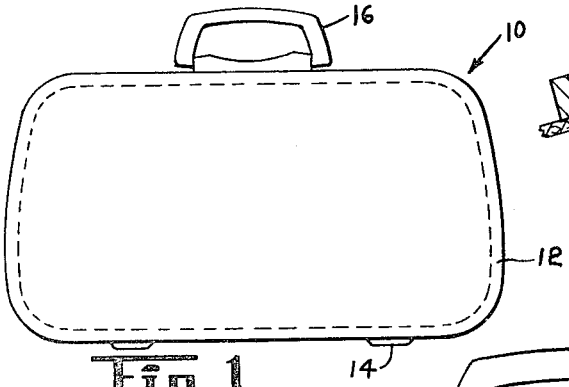
FIG. 1 is a front view of a suitcase embodying the invention.

Referring more specifically to the drawings, a suitcase embodying the invention is generally designated 10 in FIG. 1. It comprises, as is conventional, a pair of halves 12, one not shown, which fit together about the margins in a closure. Suitably, the lower ends of the halves may be formed with feet 14 and one of the halves may carry a handle 16. The suitcase embodying the invention is not provided with the conventional hinges although hinges may be used if desired or necessary.

Figure 2:
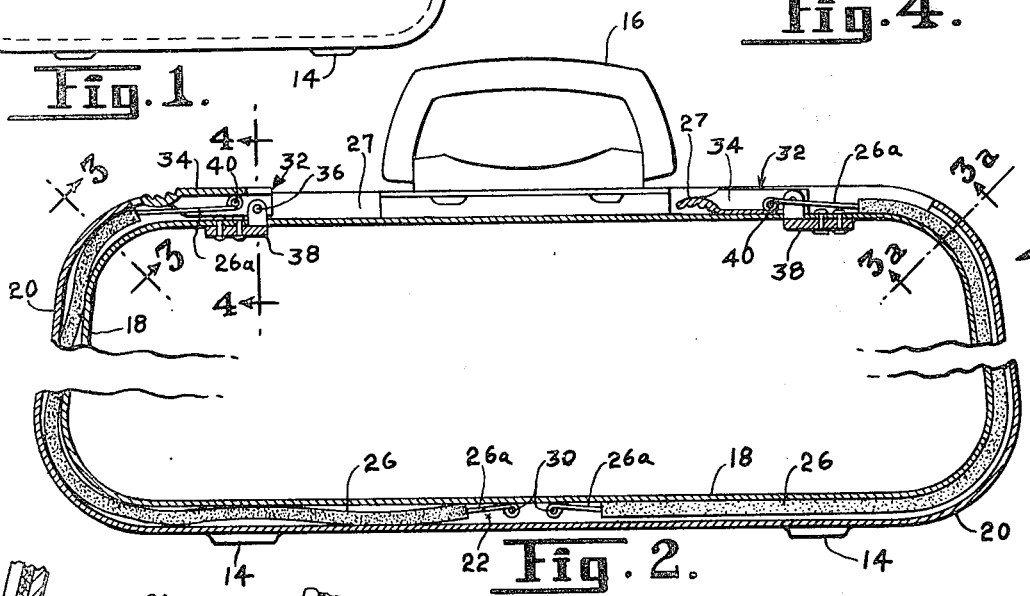
FIG. 2 is a broken sectional view of a suitcase embodying the invention wherein the suitcase is shown in the locked condition on the left-hand side and the unlocked condition on the right-hand side.

The closure of the two halves 12 comprise an inner margin 18 (FIG. 3) and an outer margin 20. The margins may be formed from extruded metal and secured, for instance, to the molded sidewalls of the suitcase as by the rivets, or cement. Alternatively, the suitcase may be so designed that the margins 18 and 20 are molded integrally with the sidewalls. The inner margin 18 is formed with an outwardly-facing recess 22 which preferably comprises a channel extending about the margin for the majority of the periphery of the suitcase (FIG. 2).

The outer margin 20 has a recess 24 opposing the recess 22 and similarly preferably extends around the periphery of the suitcase. Preferably, to seal the suitcase, the margin 18 is formed with a tapered distal end 18*a* which fits into an appropriate groove 20*a* in the margin 20 while the margin 20 is formed with a tapered edge 20*b* which fits into an appropriate groove 18*b* in the margin 18.

As shown, the recess 24 is formed with a perpendicular shoulder 24*a* and the recess 22 is formed with perpendicular shoulders 22*a* and 22*b*.

Figure 3:
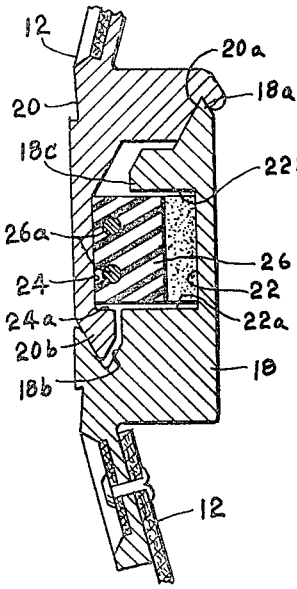
FIGS. 3 and 3*a* are, respectively, sectional views on the line 3—3 and 3*a*—3*a* showing, respectively, the suitcase locked and unlocked and partially open.

Disposed in the recess 22 is a belt-like element 26 which is preferably composed of a non-stretchable but flexible belting. It may be provided with a pair of embedded strengthening cords 26*a* and is preferably of substantial width and rectangular in cross section. As shown in FIG. 3, the stock of the margin between the recess 22 and the edge 18*a* terminates in a face 18*c* which is inward of the outer surface of the belt 26.

Figure 4:
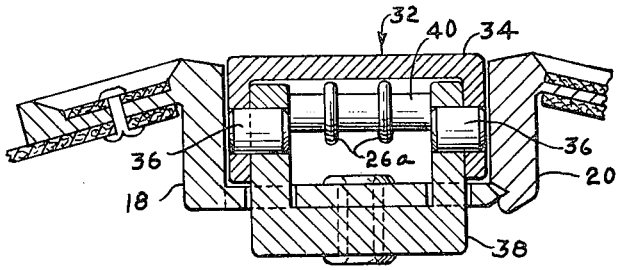
FIG. 4 is an enlarged sectional view taken on the line 4—4 of FIG. 2.
Figure 5:
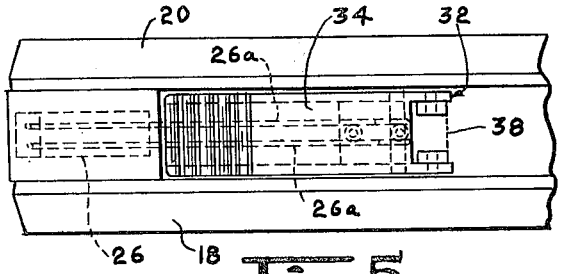
FIG. 5 is an enlarged fragmentary top view showing the locking lever and adjacent parts.

In the embodiment shown, one end of each belt-like element 26 is secured preferably by its cords 26*a* to appropriate rivets or posts 30 at a first point in the recess disposed in the recess 22. The other ends of the belts 26 are connected respectively to belt-tightening means 32 as by the cords of the belt-like elements 26. As shown in FIGS. 4 and 5, the belt-tightening means 32 may comprise a lever 34 pivoted as at 36 to a "U"-shaped yoke 38 attached to the inner margin 18 and preferably having its side arms extending up through the margin 18 through appropriate openings while the bight of the yoke is disposed actually inside the suitcase. Disposed across the inside of the lever 34 is a pin 40 to which the cords 26*a* may be attached. As shown in FIG. 2, the pin is preferably disposed at a level outward from the pins 36 so that an over-center effect is obtained as the lever is swung from open to closed positions. The belt-tightening means is thus disposed in the embodiment shown in the inner margin. The outer margin is notched as at 27 to accommodate the belt-tightening means.

Figure 3A:
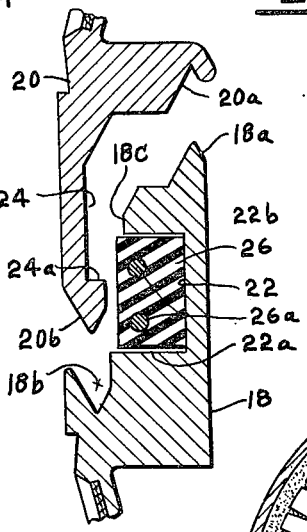

As a result of the structure described and the length of the belt 26 selected, the suitcase may have its closure in openable condition, as shown in FIG. 3*a* and the right-hand side of FIG. 2, by tightening the belt-like element by swinging the lever 34 at its inward position causing the belt 26 to be disposed inward of the recess 22.

When, on the other hand, it is desired to lock the suitcase, the margins are brought together as shown in FIG. 3 the face 18*c* serving to guide the outer margin 18 into proper position. The lever 34 is shifted to that shown on the left-hand side of FIG. 2 resulting in the element 26 assuming the position of FIG. 3 wherein it is disposed partially in both recesses 22 and 24. This prevents the opening of the closure in that the element 26, upon attempted opening, will engage the shoulders 22*b* and 24*a* of the respective recesses.

Figure 6:
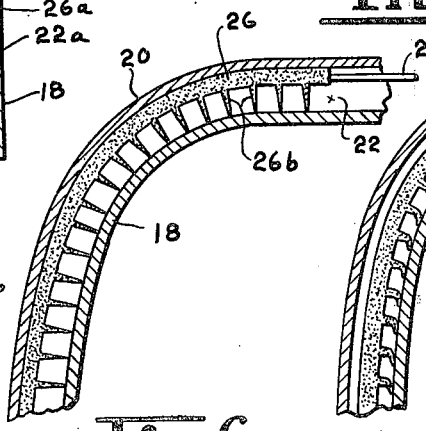
FIGS. 6 and 6*a* show in section a modified form of a belt-like element in locked and unlocked condition, respectively.
Figure 6A:
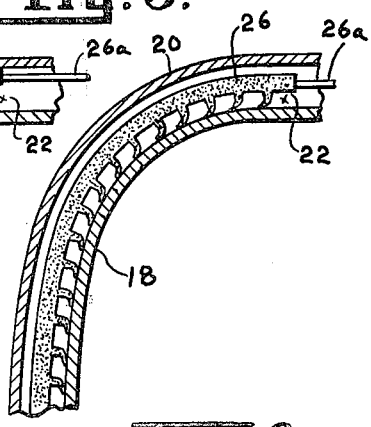

A modified form of the invention is shown in FIGS. 6 and 6*a* wherein the element 26 is formed with integral inward spaced fins 26*b* which are resilient and which urge the belt-like element away from the bottom of the recess 22, as shown in FIG. 6, when the closure is in the unlocked position. On the other hand, when the belt-tightening means 32 is tightened, the resilient fins 26*b* collapse causing the element 26 to approach the bottom of the recess 22 and to permit its outer surface to clear the margin 20 as it is moved upward in opening. The fins 26*b* may be integrally molded with the element 26.

It will be understood that many variations of the embodiment shown may be employed. The principle of the invention may be utilized in different forms, for instance, the belt-like element may be a single element (rather than two elements as shown in FIG. 2) fastened at one end and extending peripherally about the suitcase and secured to the belt-tightening means at its other end. Hinges may be used on the suitcase with the belt-like element extending along the three sides where the hinges are not present. Further, of course, key locking means may be used to prevent unauthorized manipulation of the tightening means. While the invention has been disclosed embodied in a suitcase, it is susceptible in use in other types of luggage including trunks and valises.

Thus, many variations are possible, all falling within the scope of the following claim language or equivalents thereof:

I claim:

1. A piece of luggage having a closure defined by an inner margin and an outer margin, the margins adapted to close with the inner margin fitting inside the outer margin, the inner margin having an outwardly-facing recess along the margin, the outer margin having an inwardly-facing recess along the margin, one of the recesses having therein and there-along a flexible belt-like element anchored to the said margin at one point, belt-tightening means on the said margin operatively connected to the belt-like element at a second point spaced from said one point to move the belt-like element at second point selectively toward or away from the first point, whereby when margins of the closure are closed and the recesses juxtaposed, the belt-tightening means may be used to cause the belt-like element between the points to be disposed partly in each of the recesses to hold the closure closed, or, alternatively, to cause the belt-like element between the points to be disposed entirely in the recess of the said margin to permit the closure to be opened.

2. The invention as claimed in claim 1 wherein the belt-tightening means comprises a toggle lever pivoted to the luggage adjacent the inner margin, fastened to the belt-like element at a point on the lever spaced from the point.

3. The invention as claimed in claim 1 wherein the belt-like element includes laterally resilient means formed along the face of the belt-like element adjacent the bottom of the recess on the inner margin.

4. The invention as claimed in claim 3 wherein the resilient means are integral fins disposed perpendicular to the length of the element.

5. The invention as claimed in claim 1 wherein the edge of the inner margin is tapered in thickness, narrowing as the edge is approached and the outer margin is formed adjacent the circumferential edge with a groove in which the tapered edge is disposed when the closure is closed.

6. The invention as claimed in claim 1 wherein the edge on the outer margin is tapered and the inner margin is formed with a groove inward from its recess and which receives said tapered edge of the inner margin.

7. The invention as claimed in claim 1 wherein the outward face of the inner margin that is on the side of the recess closer to the edge is disposed inward from the outer portion of the belt-like element in all positions of the belt-like element.

8. The invention as claimed in claim 1 wherein the outer margin is interrupted and the belt-tightening means is disposed on the inner margin in the interruption when the closure is closed.

9. The invention as claimed in claim 1 wherein the belt-like element is of flexible rubber or rubber-like material and has molded therein a pair of spaced longitudinal strengthening cords.

* * * * *